United States Patent [19]

Smith

[11] 4,351,378

[45] Sep. 28, 1982

[54] HYDRAULIC LOGSPLITTER ASSEMBLY

[75] Inventor: Harvey A. Smith, Hampden, Mass.

[73] Assignee: Sigma Development Corp., Hampden, Mass.

[21] Appl. No.: 227,805

[22] Filed: Jan. 23, 1981

[51] Int. Cl.[3] ..... B27L 7/00

[52] U.S. Cl. ..... 144/193 A; 144/3 K; 414/744 R

[58] Field of Search ..... 144/3 K, 193 R, 193 A; 414/744 R, 744 A, 745

[56] References Cited

U.S. PATENT DOCUMENTS 4,160,470 7/1979 Sigmund ..... 144/3 K

FOREIGN PATENT DOCUMENTS 1028933 4/1978 Canada ..... 144/3 K

*Primary Examiner*—W. D. Bray

*Attorney, Agent, or Firm*—Ross, Ross & Flavin

[57] ABSTRACT

A hydraulic logsplitter assembly including a logsplitting mechanism and comprising means for charging logs thereto consisting of:

a boom, a support mechanism supporting the boom and disposed at an angle from the vertical centerline for facilitating the free swinging of the boom at an angle from on an inclined plane under the weight of a load between charging and discharging positions, a base for rotatively supporting the support mechanism, a torsion spring interconnecting the base and support mechanism for the swinging returnably of the boom from discharging to charging position, a cable supported by the boom, a grapple unit mounted at the free end of the cable.

6 Claims, 3 Drawing Figures

HYDRAULIC LOGSPLITTER ASSEMBLY

The present invention relates to new and useful improvements and structural refinements in a hydraulic logsplitter assembly and is directed more particularly to a load handling attachment therefor adaptable for freely transporting a load horizontally via a boom means between a supply point such as a log pile where the load may be picked up and the splitter means where the load may be deposited and freely returning the boom means to original position following load deposit.

The load handling attachment comprises a boom support rotatable relative to a stand in the form of a cluster arrangement, and a laterally swingable boom mounted on and projecting outwardly from the top of the boom support.

The invention is directed particularly to the provision of a mechanism which, additional to providing means for the splitting of wood pieces such as logs, allows the ready transfer of the wood pieces from the usual woodpile to the splitting mechanism, all thereby to reduce operator fatigue and improve the work rate.

The generally upright or vertically-extended boom support mounts the boom adapted to overhang the operator, which boom is swingable in a generally horizontal plane about a generally vertical axis and mounts a hydraulic motor-driven winch drum adapted to pay out or retract a cable entrained relative to the boom support and boom so as to depend freely from the outboard end of the boom. The free end of the cable supports a grapple for engaging transporting and discharging logs in an in seriatim manner.

In its finer aspects, the invention concerns the boom arrangement, supported in generally horizontally-extending position from the generally vertically-extending boom support, and pivotal about its axis between a loading position at a logpile and a charging position at a splitter.

The organization of structure delineates an angularized boom unique in that its rotary motion in swinging from loading to discharging stations is induced simply by the weight of the load itself, thus freeing the operator of responsibilities in that regard, and in swinging returnably from discharging station (the load having been delivered) to loading station (preparatory to accepting a new charge) is induced simply by the developed torque in an associated torsion spring.

Judicious experimentation with the angularization of the boom at a particular worksite is allowed through provided adjustment means so as to ensure that the so-called "free-wheeling" of the boom is initiated or terminated at respective points vertically above the supply point and splitter so as to eliminate any concerns of the operator with respect to accurately loading and unloading his charges.

A flexible steel cable interconnects a spring-loaded grapple through the boom and boom support to a hydraulic motor and valve whereat the operator has a capacity to control the lowering and raising components of motion for the load accepting and rejecting functions.

The invention relates to the novel features or principles of the instrumentatlities described herein whether or not such are used for the stated objects, or in the stated fields or combinations, and envisions sequential steps in operation as follows:

A. With the splitter components properly retracted and ready for acceptance of a log for the splitting program, the operator causes the boom to be swung vertically above the log pile or supply point and the grapple to be lowered so as automatically to grapple a first log, the cable having been adequately paid out so as to facilitate the grappling.

B. The operator then causes the cable to be retracted or wound back upon the cable drum so as to lift the grapple and its supported log vertically upwardly from the pile wherefor the load is free of the logpile and the boom is free to move on its own downwardly along an inclined plane from its first or high position or station to its second or low position or station vertically above the splitter where the operator then through the provided controls acts to initiate cable pay out and a lowering of the grapple and log to its position of automatic discharge in the splitter trough.

C. Upon release, the boom automatically swings returnably and upwardly along the inclined plane to its first position vertically above the supply point, again without the dictate of any expended effort on operator's part.

The salient feature of the invention comprehends a particular construction, arrangement, combination, and relationship of components and instrumentalities, as exemplified in the following detailed disclosure, showing an arrangement which allows the free swinging of the boom along the inclined plane as it is rotated between first and second positions or stations, the mere load carried by the grapple being sufficient to induce the movement and allows its free and ready return upwardly along the inclined plane between the second and first positions immediately following load discharge.

The disposition of the upright and coaxially aligned boom support, and hence of the boom is along two components of angularization. With respect to the true vertical, i.e. the imaginary line perpendicular to the horizontal plane of the supporting surface, the first component of angularization is one that is slightly away from the vertical, say in the order of 5°, and toward the unloading position at the splitter. With respect to the aforesaid horizontal plane, the second component of angularization is one that is slightly away from an imaginary center line extended generally between the support stand and the splitter, say in the order of 45°, and in a direction beyond or outboard of the defined area of boom sweep.

One problem encountered by a homeowner having a fireplace is the high cost of firewood, made so in large part by the excessive amount of manual labor required to split the cut logs lengthwise to form the split fireplace logs. The present invention seeks to eliminate some of the manual labor involved, at least the extent of transporting the cut logs from a logpile or supply point to the splitter of the apparatus by a boom arrangement which supports an operator controlled grapple so that, once the grapple has engaged a log to be split at the logpile and has been mechanically raised upwardly above the logpile by the operator so as to be free to swing, the boom is allowed to swing automatically and free of operator control along a downward plane so inclined as to stop automatically over the splitter where the operator, again having reference to his hydraulic controls, effects lowering of the grapple so that the log is lowered to the log receiving trough of the splitter whereupon a hydraulic ram, again operative at the operator's will and direction, is caused to drive the log against a fixed splitting blade or blades to split the log into split firewood logs of less than a maximum allowed width or size, and the boom is allowed to swing automatically and again free of operator control along the upward plane and to stop automatically over the logpile.

One of the subsidiary objects of the invention is the provision of means wherein the speed of boom travel may be varied by adjusting the height of one of the shoes thereby varying the boom angularization.

As still another feature, leveling means are provided on the shoes to allow attainment of a level operating area before use.

One advantageous embodiment of the invention is in its portability achieved through the innovative use of pull pins and hydraulic quick disconnects.

A free-wheeling cable pulley allows the ready snaking of logs to the boom by the easy pay out of extra cable as appropriate. In this connection, a cable pull out weight may be employed to allow any desired amount of cable slack.

I know of no prior art construction which allows the handling and feeding feature as well as the splitting feature in a single mobile arrangement. Generally speaking, splitting equipment with which I am familiar is relatively fixed in location and normally requires other ancillary equipment to position the logs thereon if, in fact, the logs are not manually brought to and charged into the splitter.

This invention delineates a mobile unit which can be readily moved from site to site and at each site serve the plural functions of handling and feeding the logs to the splitter and of splitting the logs so handled and fed.

Prior constructions I have observed are attended with certain disadvantages and limitations which have militated against their more general adoption. To be deplored is the fact that although many such splitters have been developed, none has heretofore been produced which combines the features aforesaid. The paucity of suitable instrumentation has been the stimulus for improvisations, but until now, no satisfactory apparatus has been forthcoming which combines in a simple manner the desired multiplicity of salient features.

The structure is differentiated from prior structures by numerous specific characteristics which contribute essentially to its utility in defining a self-contained unit which is not only highly mobile but also capable of easy operation by a single operator.

While the invention is directed to the same general problem as the known earlier machines, one key object hereof has been to overcome the transient instabilities and other operational difficulties inherent in previously known splitters where the problems of handling the logs and feeding same to the splitter are such vexing ones.

In my improved apparatus, an operator through suitable controls is enabled to utilize the boom for loading the grapple unit with logs for in seriatim movement from the logpile to the splitter for the splitting procedure, the boom being freely and automatically swingable so that the operator is free to give more concentrated attention to the splitting program per se.

Another object is to provide an improved splitter which is compact in construction and easy to operate and maintain in addition to being highly mobile so that it may be readily moved to logging or home sites for ready positioning for the splitting activity.

Another object is to provide an apparatus offering smoothness and ease and precision in its handling and operation with minimum down time and allowing long continued use with a minimum of need for repair or maintenance, all resulting in important distinct advantages in economy of manufacture, ease of operation, reliability of performance, and capability of ready assembly with positiveness and ease of manual control and action under the varying conditions of practical use.

The objects of the invention are susceptible of attainment by use of constructions different in certain respects from that disclosed, such as minor changes and variations in dimensions, shape, form, proportion, integration, cooperation of material and/or type of subassembly and accessory, all without departing from the underlying principles, salient features, scope and spirit thereof.

While these stated objects are attainable in the preferred and disclosed embodiment, it is to be understood that, by utilizing the invention only in certain of its aspects, certain objects may be attained individually or in sub-groups, without necessarily attaining all of the objects, and in truth in the accomplishment of activities other than the handling and splitting of logs or other wood pieces.

That is, while the advantages of the invention as here outlined are best realized when all of its features and instrumentalities are combined for the purpose delineated, useful embodiments may be produced involving less than the whole and being applied to other pursuits.

The physical embodiment delineated, albeit the preferred exemplification, is indicative of only one of the multiplicity of ways in and purposes for which the principles of the invention may be employed. Same is submitted as a best known embodiment in accordance with the patent statutes and is given with a view to illustrating and explaining the precise nature of the principles of the invention and their embodiment for practical use, in order that others, skilled in the art to which the invention per tains, may be enabled to adapt and modify them in numerous variations and modifications, each as may be best adapted to the conditions of any particular use other than the one exemplified.

The precise construction of the figures of the drawing need not be slavishly followed as, of course, the mechanism may have to be adapted or alternatively constructed or modified in accordance with any specific use. Such adaptations and/or alternative constructions and/or modifications are intended to be comprehended within the meaning and purview and range of equivalence of the below subjoined claims, there being no intent to have this invention limited to or circumscribed by any specific details.

It is to be particularly stressed that the specific numbers applied to the degrees of angularization of the boom are not meant to be all controlling. That is, those given are merely exemplary. This is to say, the invention is capable of receiving a variety of geometrical expressions, one of which is shown on the accompanying drawings, but it is to be expressly understood that the drawings are for the purpose of illustration only.

In the drawings

Figure 1:
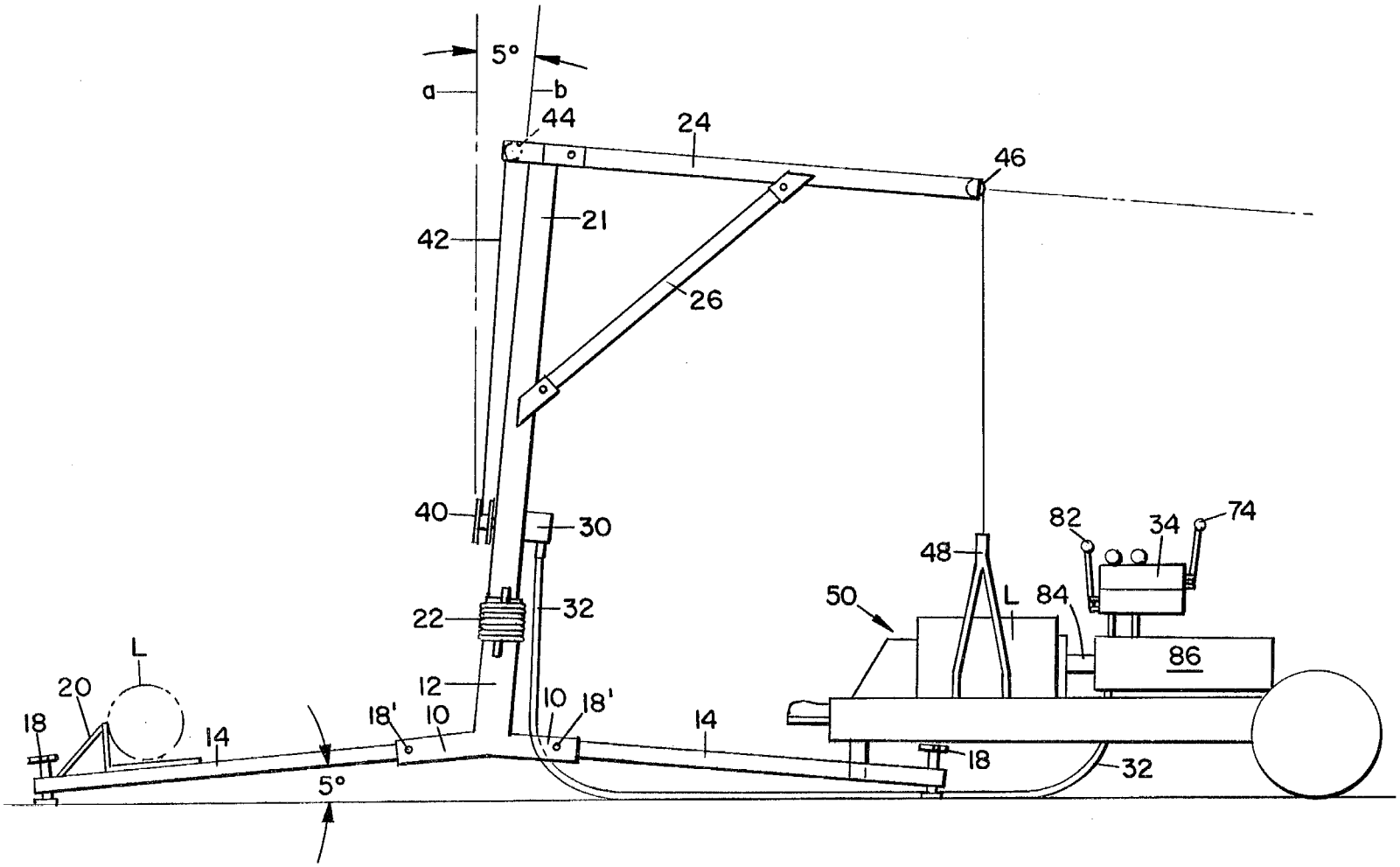
FIG. 1 is a view in side elevation of the improved apparatus of the invention.
Figure 2:
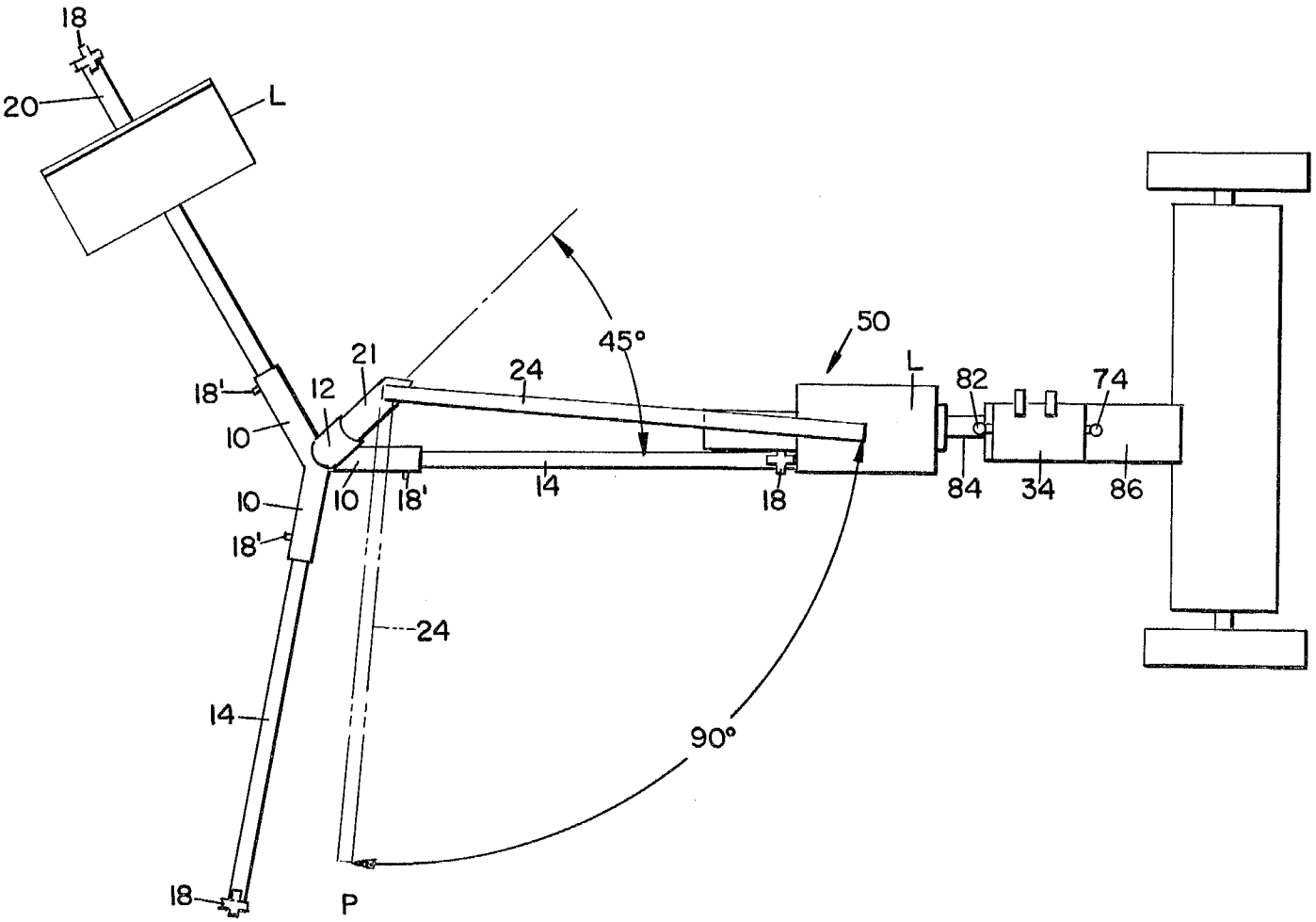
FIG. 2 is a view in top plan showing the apparatus of the invention.
Figure 3:
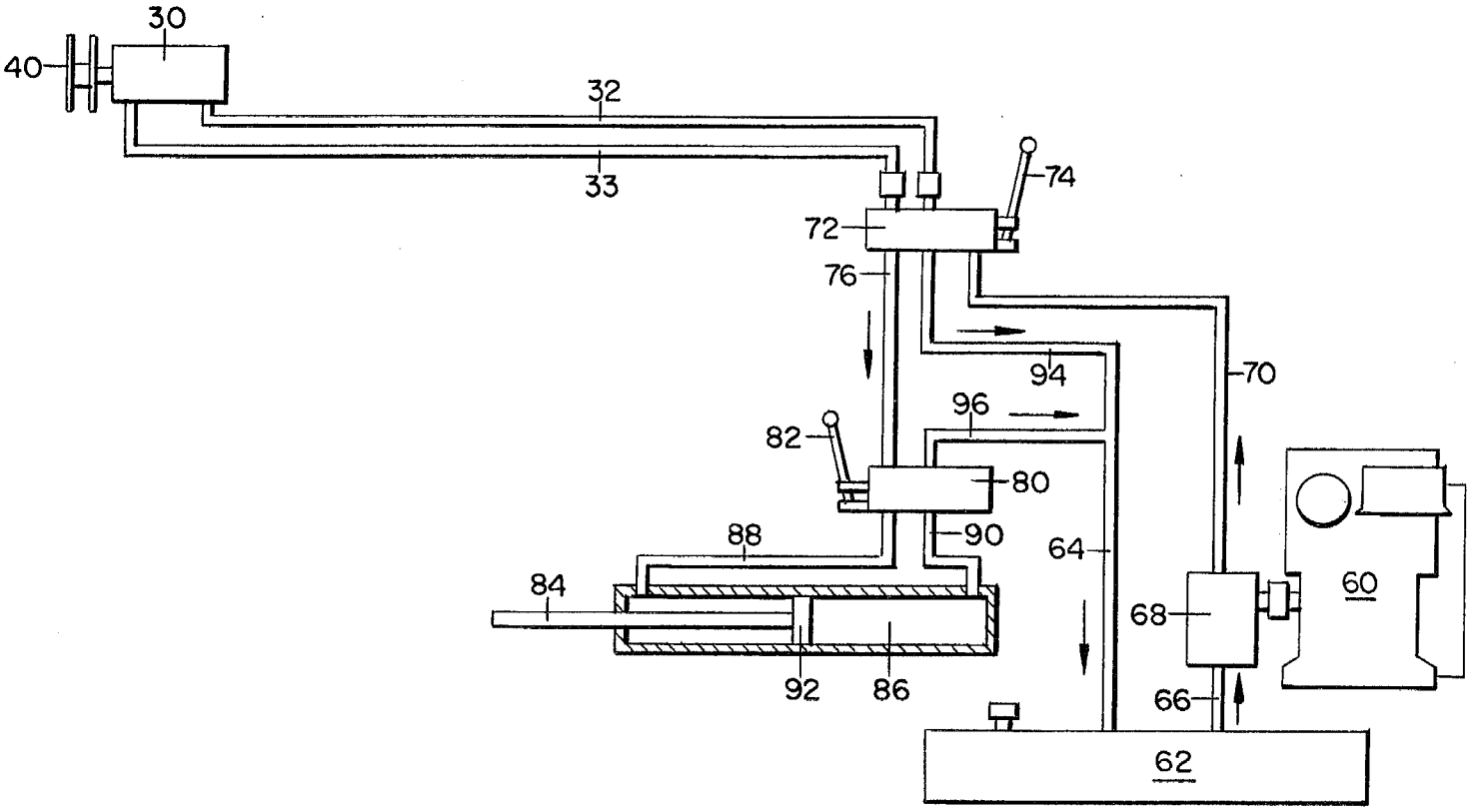
FIG. 3 is a schematic control diagram of the apparatus.

In this description and the appended claims, various components and details will be identified by specific names for purposes of convenience and in a generic and descriptive sense only. The phraseology or terminology employed is for the purpose of limitation, the terms being intended to be as generic in their application as the art will permit. They are not intended to exclude any reasonable equivalents of the features shown and described.

With continued reference now to the drawings, I have shown a preferred embodiment of the apparatus as including a Christmas tree standlike arrangement comprising a cluster of three substantially equispaced feet 10, each of tubing stock, converging at and being welded to an upright 12, likewise of tubing stock. As will subsequently appear, upright 12 is disposed at an angle away from a true vertical center line denoted a as it extends upwardly away from the center point of the cluster whereat the three feet converge.

Nestably receivable in the free outboard end of each foot 10 is a shoe 14, likewise of tubing, and slidably engageable therewith and held relative thereto as by a pull pin 18', so as to allow ready adjustment of shoe relative to its respective foot in the accommodation to any specific work site.

The feet and coaxially aligned shoes are preferentially disposed along a slight incline from the usual horizontal support, i.e. ground or flooring, say in the order of 5°, so as to elevate the cluster center point upwardly of that horizontal support, all so as to simplify any necessary jacking procedure for the essential purposes of leveling the apparatus and of ensuring the proper angularization of its boom so that it is enabled to swing freely and automatically in an arc between its loading and unloading stations or positions and to stop at each without unwanted swinging movement therebeyond. Additionally, the judicious adjustment of the feet and shoes achieves a delicate control of the speed of boom travel between its stations or positions.

A leveling jack screw 18 of conventional design may be provided on the outboard extremity of each shoe to assist in any apparatus-leveling procedure.

A counterweight subassembly designated 20 in the form of a laterally extending cradle is fixed to and transversely of that shoe most distant from the boom arrangement for counter-balance purposes. A log L may be nestably received within the cradle during operational use to provide the balancing function.

A lower extremity of a tubular boom support 21 is nestably receivable within the open upper extremity of upright 12 so as to project upwardly therefrom in coaxial relationship therewith and to be readily disassociated therefrom when apparatus disassembly is indicated.

Projecting outwardly from and fixed to the upper end of and in a plane normal to the plane of boom support 21 is a boom 24, supported relative thereto as by an angularized boom brace 26 of typical design.

A motor 30 is mounted relative to boom support 21 and is hydraulically connected to a control valve 34 by a pair of lines 32 and 33.

A driven rotative shaft extendable outwardly from motor 30 mounts a cable drum 40 from which a cable 42 may be payed out toward a first pulley 44 at the upper end of boom support 21 around which pulley the cable is entrained in passage outwardly relative to the boom which mounts a second pulley 46 at its outer extremity, around which pulley the cable is entrained in depending passage downwardly for engagement at its free terminal with a grapple 48 in the form of conventional log-engaging tongs.

The boom will normally be operative to swing in an arc of approximately 90° between a loading position over a supply point or logpile P and an unloading position over the splitter 50.

To render boom swinging a fully automatic procedure, I have found it desirable to dispose the upright of the stand and its supported coaxially-aligned boom support in two components of angularization. Firstly, they are inclined slightly, say in the order of 5°, away from the true vertical represented by a and toward the splitter 50. Secondly, they are inclined slightly, say in the order of 45°, away from the horizontal center line extended between the stand or cluster and splitter and on the side of the center line away from the area of boom sweep.

This inclination of the boom support and accordingly of the boom, allows the boom to swing as though along an inclined plane downwardly from loading point P to the unloading point over splitter 50.

As the boom so swings downwardly along this plane, the rotation exerts forces tending to turn the end of a torsion spring 22 held fast to the boom support about a longitudinal axis while the other end is held fast to the upright.

A reactive torque allows the return of the boom and boom support upwardly along the inclined plane from unloading to loading positions immediately the grapple has released its load at the splitter.

That is, torsion spring 22 is engaged at one of its ends relative to the upper extremity of upright 12 and at its opposite end relative to the lower extremity of boom support 21 so as to move with the boom support in relative movement with respect to the upright for effecting the return of the boom support and boom to normal non-operative positions.

The slitter mechanism per se, generally indicated by 50, may be of the type such as shown in the Bruckner U.S. Pat. No. 3,077,214, the Hellstrom U.S. Pat. No. 3,242,955 or the Kanik U.S. Pat. No. 4,076,062, and comprehends a ram which drives the log L horizontally toward and into a fixed splitting wedge, the ram being driven in forward splitting and rearward retracting strokes by means of a piston within a cylinder, there being fluid pressure lines connecting with the cylinder on opposite piston sides in known manner.

A single engine or power plant 60 is coupled to and drives a hydraulic pressure system indicated by the supply tank with inlet and outlet conduits 64 and 66 respectively.

The power system includes a pump 68 which is driven from the engine power supply 60 to operate the equipment of the apparatus.

A conduit 70 leads from the pump to a four-way valve 72 which is manually operated by an operator 74.

A conduit 32 leads from the 4-way valve to the hydraulic motor 30 which drives the cable drum 40.

A conduit 33 connects between the four-way valve 72 and the motor 30.

A conduit 76 leads from the four-way valve 72 to the logsplitting valve 80 which may be manually operated by an operator 82 for purposes of controlling the forward logsplitting and rearward retracting movements of the ram 84 of the logsplitter as it is motivated by way of cylinder 86, conduits 88 and 90 directing fluid to or from opposite sides of piston 92, in known manner.

Conduit 94 leads from four-way valve 72 and connects with conduit 96 leading from valve 80 returnably to reservoir 62.

The hydraulic source operated from the engine will supply fluid under pressure in two directions, that is via feed lines and return lines to the pair of valve actuators as manually controlled via operators for operating the grapple unit as the boom is articulated between load and discharge positions and for hydraulically operating the log splitting mechanism, the valves being bidirectional to allow the desired movements.

The improved mobile logsplitter may be readily moved to various logging sites and transported therebetween on highways.

The power plant will supply the power to the various actuators and other components of the apparatus.

The operator will locate himself at the control valve so that he may operate the control levers to position the grapple unit so that a log may be grappled and then raised sufficiently so as to allow the boom to swing freely toward the logsplitting mechanism where the log may be discharged in position preparatory to the operation of the splitter.

It is belived that the gist of the invention will be clearly understood from the foregoing disclosure and accordingly, further analysis thereof at this point is considered unnecessary, as I have, in accordance with the provisions of the patent statutes, described the construction and principle of operation of my invention together with the apparatus which I believe to represent the best embodiment thereof, to the end that others can, by applying current knowledge, readily adapt it for various applications without omitting features which, from the standpoint of prior art, fairly constitute essential characteristics of its generic and/or specific aspects. The substitution of equivalents and other changes, modifications and alterations as circumstances may suggest or render expedient, are reasonably contemplated, the invention being susceptible of such without departing from its real spirit or underlying principles.

The embodiments of the invention in which an exclusive property or privilege is claimed are defined as follows:

1. A hydraulic logsplitter assembly including a log splitting mechanism and comprising means for transporting and delivering logs thereto consisting of:

a horizontally-swingable boom, a support mechanism supporting the boom upwardly and disposed at an angle from the vertical centerline for facilitating the free swinging of the boom at an angle on an inclined plane under the weight of a load between charging and discharging positions, a base for rotatively supporting the support mechanism, a torsion spring interconnecting the base and support mechanism for the swinging returnably of the boom from discharging to charging position, a cable supported by the boom, and a grapple unit mounted at the free end of the cable.

2. In the category of a mobile logsplitter assembly including a logsplitting mechanism and comprising means for charging logs thereto comprising:

a boom swingable between load charging and discharging positions, a support mechanism supporting the boom and disposed at an angle from the true vertical for facilitating the free swinging of the boom along an inclined plane under the weight of a load between load charging and discharging positions, a base for rotatively supporting the support mechanism, a torsion spring interconnecting the base and support mechanism for effecting the swinging returnably of the load free boom from discharging to charging position, a cable supported by the boom, and a grapple mounted at the free end of the cable for grappling a load when the boom is in charging position and discharging the load when the boom is in discharging position.

3. A hydraulic logsplitter assembly including a logsplitting mechanism and means for transporting and delivering logs thereto consisting of:

a swingable boom disposed upwardly of a generally horizontal plane, a support mechanism supporting the boom upwardly and disposed in a first component of angularization from the true vertical and in a second component of angularization away from the line connecting between the support center and the splitting mechanism facilitating the free swinging of the boom at an angle on an inclined plane under the weight of a load between charging and discharging positions, a base for rotatively supporting the support mechanism, a torsion spring interconnecting the base and support mechanism for the swinging returnably of the boom from discharging to charging position, a cable supported by the boom, and a grapple mounted at the free end of the cable.

4. In the category of a log splitter assemblage including a splitter locatable adjacent a logpile and comprising a traversing hoist for lifting a load by an elevator means applied through a support above the load and for shifting it laterally in the transport of logs in seriatim from a charging position at the logpile to a discharging position at the splitter and consisting of:

a generally horizontally-swingable boom, a generally vertically-extending boom support for supporting the boom in right angular relationship therewith and upwardly of the logpile and splitter and being disposed in two components of angularization from the true vertical including an inclination away from the vertical and toward the splitter and an inclination away from a longitudinal centerline through the splitter and in a direction outboard of the area of boom sweep between charging and discharging positions for facilitating the free-swinging of the boom downwardly along an inclined plane under the weight of a load from charging to discharging positions, spring means for effecting the upward return swing of the load-free boom from discharging to charging position, a hoisting cable and motor-driven drum therefor operatively connected to the boom and boom support for taking in and paying out the cable in the raising of the load upwardly from the logpile and the lowering of the load downwardly to the splitter, a load-handling element carried by the free end of the cable for receiving and grappling the load when the boom is in charging position and releasing the load when the boom is in discharging position.

5. In the assembly of claim 4, including control means for effecting the raising and lowering of the grapple and for driving the splitter.

6. In the assembly of claim 4, including quick disconnect means for the disassembly of the boom support and boom.

* * * * *